United States Patent [19]

Neuhöffer et al.

[11] Patent Number: 4,920,623

[45] Date of Patent: May 1, 1990

[54] HEATABLE GLAZING OR CALENDERING ROLL

[75] Inventors: Hans-Friedrich Neuhöffer; Erich Vomhoff, both of Konigsbronn, Fed. Rep. of Germany

[73] Assignee: Schwabische Huttenwerke GmbH, Aalen-Wasseralfingen, Fed. Rep. of Germany

[21] Appl. No.: 401,515

[22] Filed: Aug. 30, 1989

Related U.S. Application Data

[63] Continuation of Ser. No. 175,995, Mar. 31, 1988, abandoned.

[30] Foreign Application Priority Data

Apr. 2, 1987 [JP] Japan ..... 3711027
May 14, 1987 [JP] Japan ..... 3716223

[51] Int. Cl.[5] ..... B21B 31/08

[52] U.S. Cl. ..... 29/129; 29/110; 29/129.5; 100/155 R

[58] Field of Search ..... 29/113.1, 116.1, 116.2, 29/129, 129.5, 130, 131, 110; 38/62, 100; 100/155 R

[56] References Cited

U.S. PATENT DOCUMENTS

| | | | |
|---|---|---|---|
| 2,498,662 | 2/1950 | Eaby | 29/130 |
| 4,607,420 | 8/1986 | Vonhoff | 29/113.1 |
| 4,730,374 | 3/1988 | Neuhöffer et al. | 29/130 |
| 4,734,966 | 4/1988 | Zaoralek | 29/130 |

FOREIGN PATENT DOCUMENTS

| | | |
|---|---|---|
| 0158220 | 10/1985 | European Pat. Off. . |
| 2438706 | 5/1980 | France . |

*Primary Examiner*—Howard N. Goldberg
*Assistant Examiner*—Irene Cuda
*Attorney, Agent, or Firm*—Armstrong, Nikaido, Marmelstein, Kubovcik & Murray

[57] ABSTRACT

A heatable glazing or calendering roll has a roll body, peripheral bores in the roll body for the passage of a fluid heat carrier, a flange journal for each end of the roll body, supply and discharge conduits for the fluid heat carrier in at least one flange journal and cutouts for the distribution of the fluid heat carrier from the supply conduits to the peripheral bores and from the peripheral bores to the discharge conduits; the cutouts are disposed in the end faces of the or each flange journal and are bordered on the opposite side by the planar end face of the roll body.

10 Claims, 1 Drawing Sheet

HEATABLE GLAZING OR CALENDERING ROLL

This application is a continuation of application Ser. No. 175,995 filed Mar. 31, 1988, now abandoned.

FIELD OF THE INVENTION

The invention relates to a heatable glazing or calendering roll of the type set forth in the preamble of claim 1.

DESCRIPTION OF THE PRIOR ART

Such a roll is disclosed in DE-GM 8,436,564, DE-GM 8,410,839 and EU-OS 158,220, which is based on said two utility models, and comprises a roll body, peripheral bores in the roll body for the passage of a fluid heat carrier, a flange journal for each end of the roll body, supply and discharge conduits for the fluid heat carrier in at least one flange journal, and cutouts or recesses for the distribution of the fluid heat carrier from the supply conduits to the peripheral bores and from the peripheral bores to the discharge conduits.

In the roll according to DE-GM 8,436,564 from the regions of the end faces bordering the cutouts a group of bores extends which diverge along generatrices of a truncated cone and which each open into one of the peripheral bores; outside said entries the peripheral passages are closed on both sides by closure plugs so that the fluid heat carrier flows against said closure plugs, disturbing the flow, this in turn leading to irregular heat transfers. Moreover, the thermal insulation between the roll body and the flange journals is not satisfactory; as explained for example in DE-OS 3,518,808 the thermal expansion of the flange journals on the one hand and of the roll body on the other hand must be matched to obtain a specific deformation of the two bearing journals and thereby compensate for example the "oxbow effect".

The same applies also to the roll according to DE-GM 8,410,839 in which the regions of the end face of the roll body enclosed by the mouths of the peripheral bores are set back with respect to the opposite base surface regions of the flange journals to form in each case a gap or a cutout extending up to the mouths of the peripheral bores; central supply and discharge conduits extend in each case up to said cutouts; this is intended to permit the heating of exactly predefined peripheral regions of the roll body.

SUMMARY OF THE INVENTION

A further problem in the known heatable glazing or calendering rolls is that the end face of the roll body must be worked to form the cutout of the recess, for example milled out or turned out. The cutouts or recesses thus formed are then in a region of the roll body in which its inherent stresses have a critical value so that any intervention in this region of the roll body increases the danger of fracture.

The invention is therefore based on the problem of providing a heatable glazing or calendering roll of the type indicated in which the above disadvantages do not occur.

In particular, a roll is to be provided which is very stable so that even after extremely long operation of the roll bodies no cracks or fractures occur.

This is achieved according to the invention by the features set forth in the characterizing clause of claim 1.

Expedient embodiments are defined by the features of the subsidiary claims.

The advantages achieved with the invention are based on the fact that the cutouts or recesses are not disposed in the end faces of the roll body but in the end faces of the or each flange journal and are bordered on one side by the opposite substantially planar end face of the roll body. This also makes it possible to continue the cutouts in the radial direction outwardly to such an extent that the peripheral bores open directly into the cutouts, i.e. the deflection of the flow of the fluid heat carrier takes place only gradually and in particular no flowing against a closure plug is necessary. The uniform flow of the fluid heat carrier thus achievable through the end regions of the roll body and flange journal leads in turn to a very uniform and defined heating in said region, as is necessary for many purposes.

In addition, due to this spatial configuration of the transfer regions between roll body and flange journals a very good heat insulation is possible in this region by lining the inner surfaces of the cutouts with an insulation material, for example of heat-insulating plastic; this thermal insulation may extend over the entire inner surface of the supply and/or discharge conduits in the flange journals and over the surfaces of the cutout. In the ends of the peripheral bores insulation bushes of heat-insulting material may be inserted and the length thereof may be adapted to the particular operating conditions desired; by choosing such insulating bushes with a specific length it is namely possible to obtain in this region an exactly defined heat transfer between the roll body and the flange journals in order, for example, to compensate the oxbow effect.

Of course, between the engagement surfaces of flange journals on the one hand and roll body on the other a heat insulation is also provided as already known from DE-OS 3,518,808.

This principle can be used both with centre rolls and with drive rolls; in the case of centre rolls both flange journals are available for passage of the fluid heat carrier so that in this design no central bore in the roll body is necessary; as a rule, however, all the roll bodies are made with a central bore so that when used as centre roll the central bore of the roll body can be closed. For this purpose at the end face of the roll body on both sides a distributor body is mounted, for example screwed on, and prevents the penetration of the fluid heat carrier into the central bore. This distributor plate can be provided with flow-conducting blades which serve to deflect the flow from the supply and discharge conduits for the fluid carrier in at least one flange journal to or from the peripheral bores; said blades are so arranged that they accelerate the incoming heat carrier in the peripheral direction and retard the outgoing heat carrier from its peripheral speed in order to ensure a uniform turbulence-free flow as is known from Pat. No. 4,734,966.

BRIEF DESCRIPTION OF THE DRAWINGS

The invention will be explained in detail hereinafter with the aid of examples of embodiment with reference to the attached schematic drawings, wherein.

DESCRIPTION OF THE PREFERRED EMBODIMENTS

Figure 1:
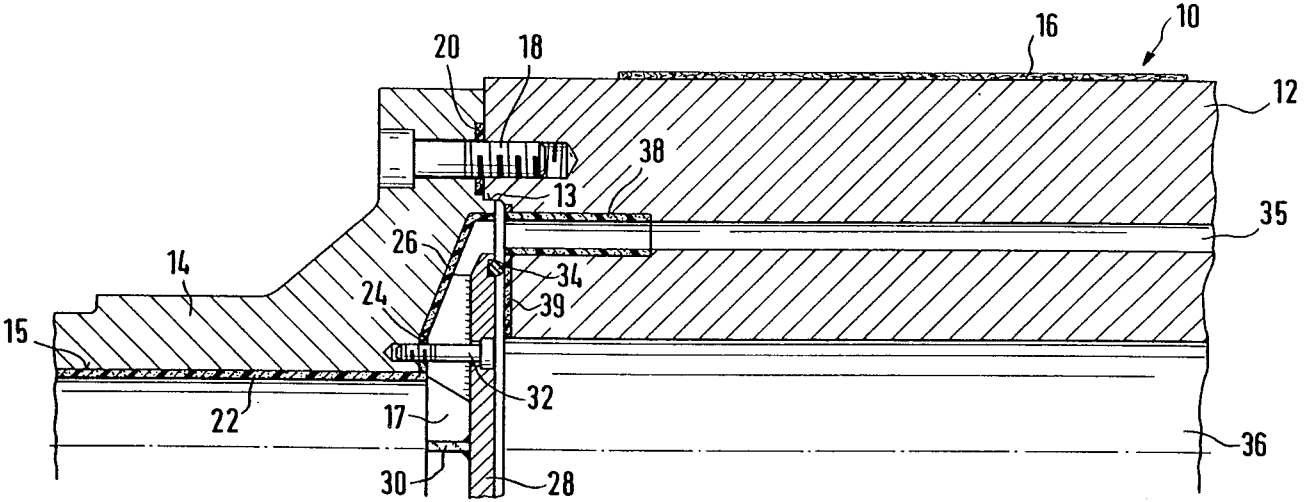
FIG. 1 is a detail section through the upper part of the left end of a centre roll.

FIG. 1 shows a centre roll which is denoted generally by the reference numeral 10 and comprises a cylindrical roll body 12 and a flange journal 14 t both sides of each roll body 12, only the left flange journal being shown in the Figure. The flange journal 14 is secured by means of a screw 18 to the end face of the roll body 12; between the two engaging end faces of flange journal 14 and roll body 12 a heat-insulating layer 20 is disposed as already known from DE-OS 3,518,808.

A web 16 to be treated, for example a paper web, is indicated on the outer cylinder face of the roll body 12.

The roll body 12 comprises an axially extending central bore 36 and a plurality of peripheral bores 35 disposed at equal angular intervals below the peripheral surface thereof. For example, eight or sixteen peripheral bores 35 may be provided which extend over the entire axial length of the roll body 12.

The end face of the roll body 12 extends substantially planar and has only a small shoulder 13 at the transition from the central region of the end face to the outer engaging face for the flange journal, where the heat-insulating layer 20 is disposed.

The flange journal 14 is likewise provided with a central bore 15 which aligns with the central bore 36 in the roll body 12 but has a somewhat smaller internal diameter; the right end face of the flange journal 14 according to the illustration of FIG. 1 is provided with a recess or cutout which starts substantially at the edge of the central bore 15 and extends radially outwardly; the radially outer edge of the cutout 17 aligns with the radially outer edge of the peripheral bores 35.

Both the central bore 15 of the flange journal 14, the wall on the flange-journals side of the cutout 17 and the mouth of the peripheral bores 35 are provided with heat-insulating layers, i.e. with a bush 22 of heat-insulating material lining the central bore 15, heat-insulating linings 24 and 26 for the cutout 17 and finally a bush 38 of heat-insulating material inserted into the mouth of the peripheral bore 35. The length of said bush 38 can be adapted to the desired operating conditions and a defined heat transfer can thus be achieved in this region.

Since in a centre roll both flange journals 14 are available for the supply and discharge of the fluid heat carrier, the central bore 36 is not required for conducting said fluid heat carrier. In many cases it may even be expedient to fill the central bore 36 with the fluid heat carrier, generally oil or water; if this is not the case the central bore 36 may be closed by a distributor plate 28 which bears on the central region of the end face of the roller body 12, except of course for the peripheral bores 35, and is held by means of a screw 32 screwed into the opposite end wall of the flange journal 14.

Between the distributor plate 28 and the end face of the roll body 12 a plate 39 of heat-insulating material is disposed in order to reduce the heat transfer from the roll body 12 to the flange journal 14 here as well. The plate 39 also covers the mouth of the central bore 36.

O-rings 34 seal the gap between the distributor plate 28 and the end face of the roll body 12. Flow-conducting blades 30 are welded onto the distributor plate 28, only one of said blades being shown in FIG. 1. Said blades 30 are arranged in such a manner that they accelerate the incoming heat carrier in the peripheral direction and retard the outgoing heat carrier from its peripheral speed and project radially into the flow passage, i.e. the cutout 17, as disclosed in Pat. No. 4,734,966.

If it is assumed in the centre roll according to FIG. 1 that the supply of the fluid heat carrier is through the central bore 15 of the flange journal 14 then a flow path for the fluid carrier results from the central bore 15 via the cutout 17, which is bordered on the one side by the planar distributor plate 28 and on the other side by a milled or turned-out portion in the end wall of the flange journal 14, to the peripheral bores 35, the blades 30 performing the flow-guiding function explained. This flow is substantially free of eddies so that defined flow and thus also temperature conditions result.

On the side not illustrated the flow runs outwardly from the bores 35 via the cutout 17 to the bore 15 in the other flange journal 14.

Figure 2:
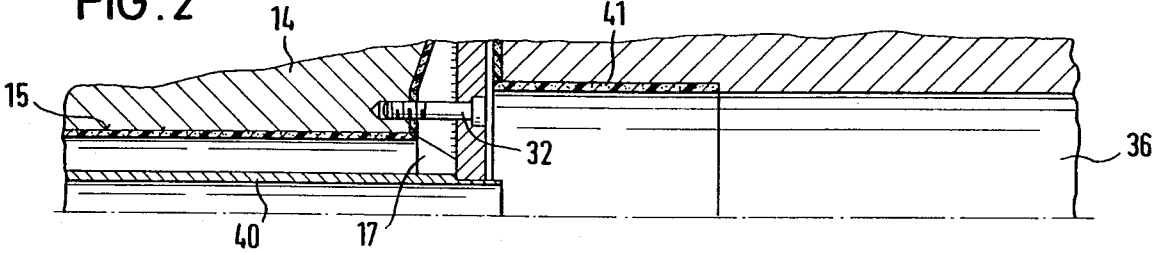
FIG. 2 is a similar view of the heating side of a drive roll.

FIG. 2 shows the heating side of a drive roll in which a flange journal is required for coupling to the drive means; in this case the central bore 36 must be used for returning the fluid heat carrier.

In such a drive roll a tube 40 is inserted into the central bore 15 of the flange journal 14 and extends coaxially with the wall of the central bore 15 and opens into the central bore 36 of the roll body 12.

In such an embodiment the fluid heat carrier is supplied on the heating side, for example, through the annular gap between the tube 40 and the inner wall of the central bore 15 and is guided via the cutout 17 outwardly to the peripheral bores 35 which are not shown in FIG. 2.

On the opposite drive side the fluid heat carrier is supplied from the peripheral bores 35 via a corresponding cutout 17 in the end face of the flange journal 14 to the central bore 36 of the roll body 12 and flows through said central bore l36 until it is finally further conducted through the tube 40 on the heating side of the drive roll.

A bush 41 of heat-insulating material is inserted into the end of the central bore 36 of the roll body facing the flange journal 14 and reduces in this region the heat transfer from the fluid heat carrier in the central bore 36 to the roll body and thus to the flange journal 14.

What is claimed is:

1. A heatable glazing or calendering roll comprising:

a cylindrical roll body having a central bore, an outer material contacting cylindrical surface and axially spaced end faces extending from said central bore to said outer cylindrical surface, a plurality of peripheral bores extending axially through the cylindrical roll body for the passage of a fluid heat carrier, each of said plurality of peripheral bores opening through said axially spaced end faces of said roll body between said roll body central bore and said outer cylindrical surface, a flange journal for each end of the roll body, supply and discharge conduits for the fluid heat carrier including a central bore in at least one flange journal, a cutout in the end face of said at least one flange journal and bounded by an end face of said roll body, said cutout extending from said central bore of said flange radially outward to said end face openings of said plurality of peripheral bores to provide distribution of a fluid heat carrier to each of said plurality of peripheral bores, and a heat insulating bush in each of said plurality of peripheral bores receiving fluid heat carrier from said supply conduit.

2. A heatable glazing or calendering roll according to claim 1, wherein at least one of the central bore (15) in said at least one flange journal (14) and the wall on the flange journal side of the cutout (17) is provided with a lining (22, 24, 26) of a heat-insulating material.

3. A heatable glazing or calendering roll according to claim 1, wherein said roll is a drive roll and said conduits in said at least one flange journal (14) include an inner tube (40) coaxial with said central bore (15) in said flange journal and communicating with said central bore (36) of the roll body (12).

4. A heatable glazing or calendering roll according to claim 3, wherein a bush (41) of heat-insulating material is inserted into the open end of the central bore (36) of the roll body (12) facing said at least one flange journal (14).

5. A heatable glazing or calendering roll according to claim 1, wherein said roll is a centre roll and said central bore (36) in the roll body (12) is closed by means of a distributor plate (28) at each end of said roll body.

6. A heatable glazing or calendering roll according to claim 5, further including an O-ring between each distributor plate (28) and each end face of the roll body (12).

7. A heatable glazing or calendering roll according to claim 5, wherein each distributor plate (28) is secured to a flange journal (14).

8. A heatable glazing or calendering roll according to claim 7, wherein blades are attached to the sides of the distributor plates (28) facing the flange journal (14) to accelerate the incoming fluid heat carrier in the peripheral direction and retard the outgoing fluid heat carrier from its peripheral speed.

9. A heatable glazing or calendering roll according to claim 8, wherein at least two blades (30) are provided to project radially into each cutout (17).

10. A heatable glazing or calendering roll according to claim 5, wherein a plate (39) of heat-insulating material is disposed between each distributor plate (28) and an end face of the roll body (12).

* * * * *

UNITED STATES PATENT AND TRADEMARK OFFICE

CERTIFICATE OF CORRECTION

PATENT NO. : 4,920,623

DATED : May 1, 1990

INVENTOR(S) : NEUHÖFFER et al

It is certified that error appears in the above-identified patent and that said Letters Patent is hereby corrected as shown below:

On the cover page, Item [30],
"Apr. 2, 1987 [JP] Japan ..... 3711027
May 14, 1987 [JP] Japan ..... 3716223"

should read:
--Apr. 2, 1987 [DE] Fed. Rep. of Germany ... 3711027
May 14, 1987 [DE] Fed. Rep. of Germany ... 3716223--.

Signed and Sealed this

Seventeenth Day of December, 1991

*Attest:*

HARRY F. MANBECK, JR.

*Attesting Officer*

*Commissioner of Patents and Trademarks*